US007233755B2

(12) United States Patent
Tango et al.

(10) Patent No.: US 7,233,755 B2
(45) Date of Patent: Jun. 19, 2007

(54) IMAGE FORMING APPARATUS

(75) Inventors: Makiko Tango, Uji (JP); Yuji Nagatomo, Amagasaki (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 83 days.

(21) Appl. No.: 10/813,077

(22) Filed: Mar. 31, 2004

(65) Prior Publication Data

US 2005/0047830 A1 Mar. 3, 2005

(30) Foreign Application Priority Data

Sep. 3, 2003 (JP) ..... 2003-311041

(51) Int. Cl.
*G03G 21/06* (2006.01)

(52) U.S. Cl. ..... 399/175; 399/350; 399/353; 399/343

(58) Field of Classification Search ..... None
See application file for complete search history.

(56) References Cited

U.S. PATENT DOCUMENTS 3,841,751 A * 10/1974 Draugelis et al. ..... 430/47
3,856,295 A * 12/1974 Looney ..... 271/65
3,917,397 A * 11/1975 Tanaka et al. ..... 399/354
4,465,357 A * 8/1984 Mugrauer et al. ..... 399/75
4,935,316 A * 6/1990 Redey ..... 429/50
5,177,553 A * 1/1993 Ohike et al. ..... 399/353
5,196,888 A * 3/1993 Matsuda et al. ..... 399/267
5,233,395 A * 8/1993 Kohyama ..... 399/314
5,426,488 A * 6/1995 Hayakawa et al. ..... 399/174
5,546,177 A * 8/1996 Thayer ..... 399/353
5,563,691 A * 10/1996 Hayakawa et al. ..... 399/149
5,606,401 A * 2/1997 Yano ..... 399/175
5,648,840 A * 7/1997 Ikunami et al. ..... 399/262
5,671,476 A * 9/1997 Ishiguro et al. ..... 399/354

(Continued)

FOREIGN PATENT DOCUMENTS

JP 63-210862 9/1988

(Continued)

OTHER PUBLICATIONS

Image processing apparatus e.g. color printer includes speed controller which maintains rotational speed ofcleaning brush at predetermined level. Brown et al. Derwent. Mar. 2003.*

*Primary Examiner*—Gail Verbitsky
(74) *Attorney, Agent, or Firm*—Morrison & Foerster LLP

(57) ABSTRACT

An image forming apparatus which reduces abrasion of a photosensitive drum caused by a rotary brush such as an charging brush for electrically charging the surface of a photosensitive drum or a cleaning brush for cleaning the surface of a photosensitive drum. The rotary brush is in contact with the photosensitive drum. During the period of charging the photosensitive drum or cleaning its surface, the rotary brush is rotated in a first mode in which the brush rotates rubbing and sliding the surface of the photosensitive drum, and during other periods, in a second mode in which the brush is rotated passively as driven by rotation of the photosensitive drum. Abrasion of the photosensitive drum is reduced by properly controlling the width of contact between the rotary brush and photosensitive drum and the amount of push for pressing the brush against the photosensitive drum.

7 Claims, 13 Drawing Sheets

U.S. PATENT DOCUMENTS

| | | | | |
|---|---|---|---|---|
| 5,708,932 | A * | 1/1998 | Yano et al. | 399/159 |
| 5,771,424 | A * | 6/1998 | Lindblad et al. | 399/71 |
| 5,845,174 | A * | 12/1998 | Yasui et al. | 399/101 |
| 5,864,733 | A * | 1/1999 | Mae et al. | 399/46 |
| 6,134,407 | A * | 10/2000 | Ishiyama et al. | 399/174 |
| 6,341,207 | B1 * | 1/2002 | Sasaki et al. | 399/149 |
| 6,377,761 | B1 * | 4/2002 | Nichols | 399/34 |
| 6,470,154 | B1 * | 10/2002 | Shinohara | 399/71 |
| 6,640,072 | B2 * | 10/2003 | Inoue | 399/167 |
| 6,898,401 | B2 * | 5/2005 | Okano et al. | 399/176 |
| 6,915,093 | B2 * | 7/2005 | Hatakeyama | 399/175 |
| 6,936,394 | B2 * | 8/2005 | Okado et al. | 430/111.33 |
| 2002/0181965 | A1 * | 12/2002 | Shimizu et al. | 399/50 |
| 2003/0235419 | A1 * | 12/2003 | Ota | 399/50 |
| 2004/0022558 | A1 * | 2/2004 | Okano et al. | 399/175 |
| 2004/0043419 | A1 * | 3/2004 | Rothman et al. | 435/7.1 |
| 2004/0045581 | A1 * | 3/2004 | Boomgaarden et al. | 134/6 |
| 2004/0047642 | A1 * | 3/2004 | Kosuge | 399/53 |
| 2005/0169668 | A1 * | 8/2005 | Koichi et al. | 399/149 |

FOREIGN PATENT DOCUMENTS

| | | | |
|---|---|---|---|
| JP | 06138798 | A * | 5/1994 |
| JP | 63-348105 | | 12/1994 |
| JP | 07311480 | A * | 11/1995 |
| JP | 2002182536 | A * | 6/2002 |
| JP | 2002-287599 | | 10/2002 |

* cited by examiner

Fig. 11

| | A | B | C |
|---|---|---|---|
| FIBER PLANTING DENSITY F/25.4mm$^2$ | 30K-500K | 50K-500K | 30K-100K |
| FIBER FINENESS D | 2D-10D | 2D-6D | 4D-10D |
| FIBER LENGTH | 3mm-7mm | | |

Fig. 12

EXPERIMENT I (Electrifying Brush - Photosensitive Drum)

| | Passive/Active Rotation Mode Switching | Amount of Push p [Nip width n] | Drum Drive Time(s) [Number of Rotation(n)] Before Forced Rotation of Brush | | Voltage Application in Passive Rotation | Degree of Abrasion (μm) | Disorder of Brush Fiber | Image Unevenness | Over all Evaluation |
|---|---|---|---|---|---|---|---|---|---|
| Sample 11 | YES | 0.5mm (4.9mm) | 240(s) | about 1100(n) | YES | 0.9 | ◎ | ◎ | ◎ |
| Sample 12 | YES | 0.08mm (2.0mm) | 240(s) | about 1000(n) | NO | 1.9 | ○ | ○ | △ |
| Sample 13 | YES | 0.5mm (4.9mm) | 240(s) | about 1100(n) | NO | 1.3 | ◎ | ◎ | ◎ |
| Sample 14 | YES | 2.0mm (9.2mm) | 240(s) | about 1400(n) | NO | 2.0 | ◎ | ◎ | ◎ |
| Sample 15 | YES | 0.5mm (4.9mm) | 2800(s) | about 12300(n) | NO | 2.0 | ○ | ○ | △ |
| Sample 16 | YES | 2.0mm (9.2mm) | 1700(s) | about 10200(n) | NO | 2.3 | ○ | ○ | △ |
| | | | | | | | | | |
| Reference 11 | NO | 0.5mm (4.9mm) | ——— | ——— | ——— | 4.6 | ◎ | △ | △△ |
| Reference 12 | YES | 0.05mm (1.5mm) | 240(s) | about 1000(n) | YES | 2.1 | ○ | × | × |

Fig. 13

EXPERIMENT II (Cleaning Brush – Photosensitive Drum)

| | Passive/Active Rotation Mode Switching | Amount of Push p [Nip width n] | Drum Drive Time(s) [Number of Rotation(n)] Before Forced Rotation of Brush | | Voltage Application in Passive Rotation | Degree of Abrasion (μm) | Disorder of Brush Fiber | Image Uneveness | Over all Evaluation |
|---|---|---|---|---|---|---|---|---|---|
| Sample 21 | YES | 0.5mm (5.6mm) | 840(s) | about 2900(n) | YES | 1.2 | ◎ | ◎ | ◎ |
| Sample 22 | YES | 0.06mm (2.0mm) | 1680(s) | about 5400(n) | NO | 1.9 | ○ | ○ | △ |
| Sample 23 | YES | 0.1mm (2.5mm) | 1680(s) | about 5400(n) | NO | 1.2 | ◎ | ◎ | ◎ |
| Sample 24 | YES | 0.5mm (5.6mm) | 1680(s) | about 5700(n) | NO | 1.2 | ◎ | ◎ | ◎ |
| Sample 25 | YES | 1.76mm (10.0mm) | 1680(s) | about 6900(n) | NO | 1.6 | ◎ | ◎ | ◎ |
| Sample 26 | YES | 2.0mm (10.6mm) | 1680(s) | about 7100(n) | NO | 1.9 | ◎ | ○ | ○ |
| Sample 27 | YES | 0.5mm (5.6mm) | 4400(s) | about 14990(n) | NO | 1.7 | ○ | ◎ | ○ |
| Sample 28 | YES | 0.5mm (5.6mm) | 5900(s) | about 20100(n) | NO | 1.7 | △ | ◎ | △ |
| Sample 29 | YES | 1.76mm (10.0mm) | 3700(s) | about 15200(n) | NO | 2.0 | ○ | ◎ | ○ |
| | | | | | | | | | |
| Reference 21 | NO | 0.5mm (5.6mm) | ——— | ——— | ——— | 5.2 | ◎ | △ | △△ |
| Reference 22 | YES | 0.05mm (1.8mm) | 1680(s) | about 5400(n) | NO | 1.1 | ○ | × | × |
| Reference 23 | YES | 2.5mm (11.6mm) | 1680(s) | about 7800(n) | NO | 2.7 | ○ | × | × |

IMAGE FORMING APPARATUS

This application is based on application No.2003-311041 filed in Japan, the contents of which are hereby incorporated by reference.

BACKGROUND OF THE INVENTION

1. Field of the Invention

The present invention relates to an electrophotographic image forming apparatus and more particularly to a rotary brush that is used for a charger for electrically charging a photosensitive image carrier or intermediate transfer medium, a cleaning device for removing residual toner from the surface of an photosensitive image carrier or an intermediate transfer medium, or another similar device.

2. Prior Art

In an electrophotographic image forming apparatus, rotary brushes are used for various purposes. For example, they are used for devices such as: a brush charger which electrically charges an photosensitive image carrier; a transfer brush which gives a carrying power or an electrostatic transfer field to a transfer rotor; and a cleaning brush which removes residual toner from the surface of a photosensitive image carrier. A rotary brush is located in contact with a members opposite to it, like a photosensitive image carrier or a transfer rotor (hereinafter referred to as an opposite member). Generally, in order to produce a larger charging effect or cleaning effect, the brush is rotated at a peripheral velocity different from the peripheral velocity of the opposite member. However, this peripheral velocity difference might cause abrasion not only of the rotary brush but also of the opposite member surface and as a consequence, such surface degradation might deteriorate the image quality and shorten the service life of the opposite member and the rotary brush, thus unfavorably affecting durability.

As a first solution to this problem, such a constitution has been proposed that the longitudinal tips of the rotary brush fibers are curled and the brush is arranged to stay off the opposite member while it is not rotating, and come into contact with the opposite member by its centrifugal force while it is rotating (Japanese Examined Patent Publication No. H4-62665). A second proposed constitution is such that the rotary brush is in contact with the opposite member while the case cover of the image forming apparatus is closed and becomes off the opposite member while the case cover is open (Japanese Laid-open Patent Publication No. H6-348105).

A third proposed constitution concerns a cleaning device having a rotary cleaning member which performs cleaning while in contact with an opposite member (photosensitive drum) (Japanese Laid-open Patent Publication No.2002-287599). The device has a drive means to rotate the photosensitive drum and the rotary cleaning member in the same direction with a peripheral velocity difference, and a switching means to transmit the driving force from the drive means to the rotary cleaning member and shut it off, and while the driving force is not being transmitted from the drive means to the rotary cleaning member, the rotary cleaning member is rotated passively by the photosensitive drum.

In the above first constitution, the amount of push for pressing the rotary brush against the opposite member is restricted and therefore it is difficult to assure a stable brushing effect. Regarding the above second constitution, it has been pointed out that the durability of the rotary brush and the opposite member may be improved but their structures are more complicated, resulting in a larger size apparatus.

In the third constitution, when the rotary cleaning member which is rotated passively in contact with and driven by the opposite member (photosensitive drum) is a rotary brush, if the conditions for the brush to be driven (rotated passively) are not properly set, a peripheral velocity difference may arise in the plane of contact between the opposite member and the rotary brush, and as a consequence, the effect of abrasion reduction will not be sufficient. In other words, although the rotary brush fiber tips are in point contact with the opposite member and the overall contact area is small, the brush fiber tip orientation and contact pressure have wide latitude and thus, unless the amount of push for pressing the rotary brush against the opposite member is properly set, the effect of abrasion reduction will not be sufficient. The present invention is intended to solve the above problem.

SUMMARY OF THE INVENTION

The primary object of the present invention is to provide an image forming apparatus which reduces abrasion of a photosensitive image carrier such as a photosensitive drum by properly setting the contact condition for a rotary brush which rotates in contact with the photosensitive image carrier.

Another object of the present invention is to provide an image forming apparatus in which, when a rotary brush for use in an charger for electrically charging a photosensitive image carrier, a cleaning device for cleaning the surface of a photosensitive image carrier, or a cleaning device for cleaning the surface of an intermediate transfer medium is rotated, the width of its contact with the photosensitive image carrier and the amount of push are properly controlled for the purpose of reducing abrasion of the photosensitive image carrier.

A further object of the invention is to provide an image forming apparatus in which a rotary brush located in contact with a photosensitive image carrier is rotated in a first mode during its periods of charging the photosensitive image carrier or cleaning the surface of the photosensitive image carrier, and in a second mode during other operation periods for the purpose of reducing abrasion of the photosensitive image carrier, where the rotary brush rotates rubbing the surface of the photosensitive image carrier in the first mode and the rotary brush rotates passively as driven by rotation of the photosensitive image carrier in the second mode.

These and other objects of the invention will become apparent from the following detailed description with reference to the accompanying drawings.

BRIEF DESCRIPTION OF THE DRAWINGS

FIGS. 3(*a*) and 3(*b*) illustrates an example of a mode switching device for an charging brush with an electromagnetic clutch off and on;

FIG. 11 is a diagram showing the features of different types of rotary brush fibers;

FIG. 12 is a diagram showing experiment results for rotary brush experiment I; and FIG. 13 is a diagram showing experiment results for rotary brush experiments II.

DETAILED DESCRIPTION OF THE PREFERRED EMBODIMENTS

Next, preferred embodiments of the present invention will be described.

First Embodiment

The first embodiment is a rotary brush according to the invention which is used for a charger.

<General Structure of an Image Forming Apparatus>

Figure 1:
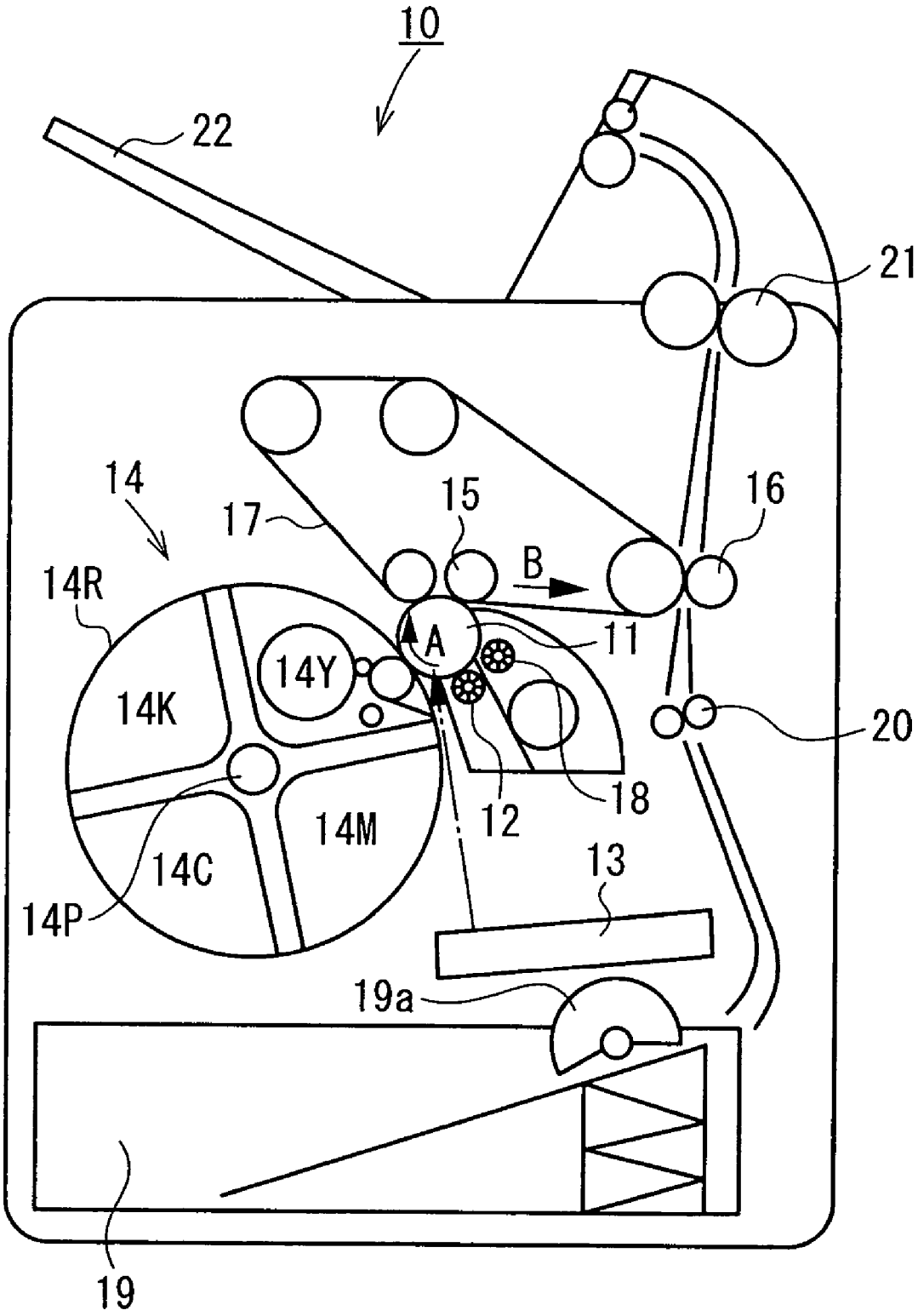
FIG. 1 illustrates the general structure of an image forming apparatus according to a first embodiment of the present invention.

FIG. 1 outlines the general structure of a full color image forming apparatus 10 according to the first embodiment of the present invention. The full color image forming apparatus 10 has a photosensitive drum 11, a brush charger 12 located around the drum, a laser scan optical system 13, a full color developing device 14, a primary transfer device 15, a secondary transfer device 16, an intermediate transfer belt 17, a cleaning device 18, a paper feed cassette 19, timing rollers 20, a fixing device 21, and a paper delivery tray 22. In the full color developing device 14, a developing unit 14Y loaded with yellow toner, a developing unit 14M loaded with magenta toner, a developing unit 14C loaded with cyan toner, and a developing unit 14K loaded with black toner move to a position opposite to the photosensitive drum 11 sequentially. The structure and operation of the abovementioned type of full color image forming apparatus 10 are well known and thus not described in detail here.

<Charger>

Figure 2:
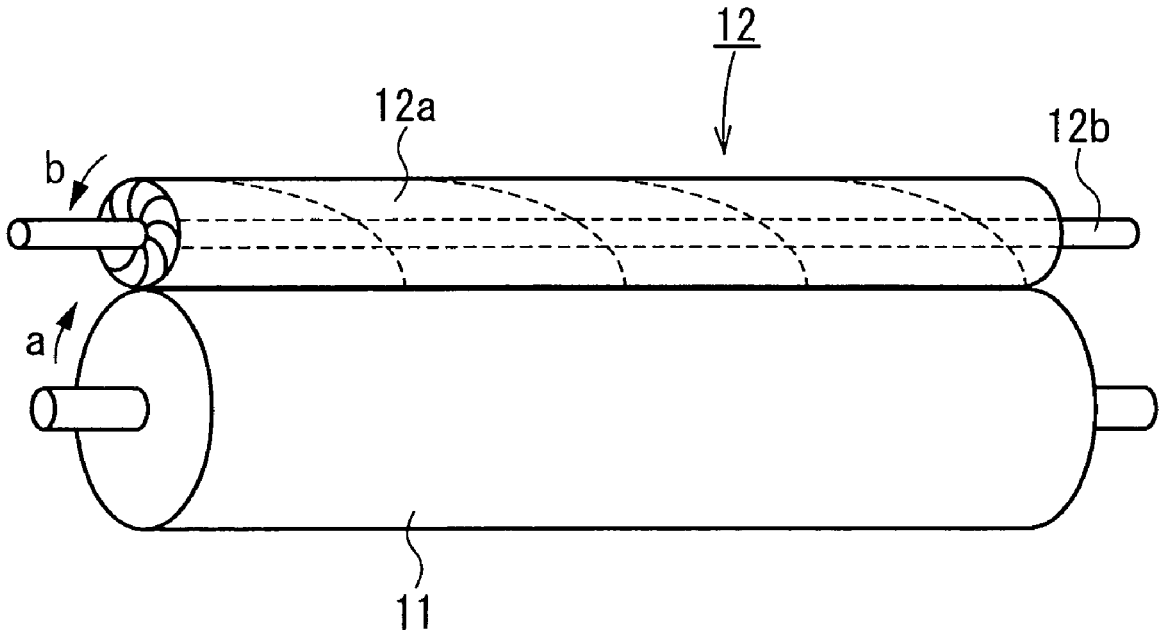
FIG. 2 is a perspective view showing a brush charger.

FIG. 2 is a perspective view showing the structure of the brush charger 12. In the brush charger 12, the roller type charging brush 12*a* is designed to rotate in contact with the surface of the photosensitive drum 11; as voltage is applied to the charging brush 12*a*, it rotates and charges the surface of the photosensitive drum 11 uniformly.

The charging brush 12*a* is made by winding a fiber-planted base cloth around a conductive support core 12*b*. The conductive support core 12*b* is usually made of a metal such as stainless steel or aluminum. However, it may be made of any other conductive material. The brush fiber planted on the base cloth are made of semiconductive fiber such as synthetic resin mixed with a conductive material.

The synthetic resin may be polyamide, cellulose, polyester, polyolefin, polycarbonate, polyurethane, polyvinyl alcohol, or acrylic resin. Preferably it should be a polyamide resin. The conductive material which is mixed with the resin may be conductive carbon, metal powder, zinc oxide, titanium oxide, tin oxide or the like. However, it may be any other material as far as it can be homogeneously mixed with the resin.

The fiber planting density, fiber fineness (diameter) and fiber length are explained next. FIG. 11 shows the recommended ranges of planting density, fiber fineness and fiber length for the charging brush as a rotary brush or a cleaning brush.

The fiber planting density is expressed as the number of filaments per 25.4 mm square (1 inch square). The fiber fineness (diameter) is expressed in denier D and the fiber length in mm. For the planting density, K represents 1000 (filaments) and thus 30K represents 30,000 (filaments).

It is desirable that the charging brush's fiber planting density, fiber fineness(diameter) and fiber length be in the ranges shown in Column A of FIG. 11. That is, planting density range is 30K to 500K, fiber fineness range is 2D to 10D, fiber length range is 3 mm to 7 mm. However, if they are in the ranges shown in Column B (fiber is slightly thinner), better charging uniformity can be achieved. The figures in Column C shows the recommended ranges of fiber planting density and fiber fineness for cleaning brush.

The base cloth on which brush fibers are planted thereon is wound around the conductive support core 12*b* spirally as illustrated in FIG. 2. However, the way of winding the fiber-planted base cloth around the conductive support core 12*b* is not limited thereto. Any other way of winding may be used as far as the fiber-planted base cloth is wound with no space left. If there should be considerably large spaces not covered with the fiber-planted base cloth, the brush fiber planting density would be low, which could cause a charge failure.

As illustrated in FIG. 2, the brush charger 12 is so located that its charging brush 12*a* rotates in contact with the surface of the photosensitive drum 11. The amount of push p for pressing the charging brush 12*a* against the photosensitive drum 11 should be set so as to satisfy condition (1) given below and the nip width n in the area of contact between the rotary brush and the rotary member should be set so as to satisfy condition (2) given below.

$$0.1\ \text{mm} \leqq p \leqq 2.0\ \text{mm} \quad (1)$$

$$2.0\ \text{mm} \leqq n \leqq 10.0\ \text{mm} \quad (2)$$

Either condition (1) or condition (2) or both should be satisfied. When the amount of push and the nip width are within the ranges indicated by these conditions, the photosensitive drum 11 will be sufficiently charged by the charging brush 12*a* and when the drive for the charging brush 12*a* is turned off, it rotates passively as driven by rotation of the photosensitive drum 11.

During initialization just after turning on the image forming apparatus or during its warm-up just after the standby state, the photosensitive drum may be rotated idly. Also, if the photosensitive drum and another device (for example, a recording paper conveying device) share a drive system, before formation of a toner image on the photosensitive drum or even after completion of image transfer onto recording paper, the photosensitive drum may continue rotating because the other device is to be driven.

However, when the amount of push and the nip width for the charging brush are within the above ranges, abrasion of the photosensitive drum which might occur during its idling can be prevented, which will be detailed in connection with experiments later.

The direction of rotation of the charging brush 12*a* is the direction of arrow b in FIG. 2, a forward direction (called the "with" direction) with respect to the direction of rotation of the photosensitive drum 11 (direction of arrow a). Alternatively, the direction of rotation of the charging brush 12*a* may be opposite with respect to the direction of rotation of the photosensitive drum 11 (direction of arrow a) (the opposite direction is called the "counter" direction). In that case, the fibers of the charging brush 12*a* are curled in a way that the fibers fall down as the brush rotates. Namely, when the charging brush 12*a* rotates in the counter direction with respect to the direction of rotation of the photosensitive drum 11, the brush fibers should be curled in the direction opposite to the counter direction.

The peripheral velocity of rotation of the charging brush 12*a* should be higher than the peripheral velocity of the photosensitive drum 11. When the peripheral velocity ratio of the charging brush 12*a* to the photosensitive drum 11 is more than 1, uniformity in electrification of the photosensitive drum 11 is improved.

The voltage of the surface of the photosensitive drum 11 is set to a prescribed level by applying voltage to the charging brush 12*a*. It is desirable that the voltage to be applied to the charging brush 12*a* be in the range of −1600 VDC to −800 VDC. However, it is not limited to this range. When charge bias voltage as DC voltage superimposed with AC voltage is applied, it is recommended that peak-to-peak AC voltage be in the range from 500 V to 2000 V, the frequency in the range from 50 Hz to 2000 Hz and DC voltage in the range from −400 V to −1200 V.

<Scan Optical System>

The laser scan optical system 13 has a known structure which incorporates a laser diode, a polygon mirror, and an fθ optical element. Y (yellow), M (magenta), C (cyan) and K (black) image data are sent from a computer (not shown) to the control unit of the laser scan optical system 13. The respective color image data as laser beams which are outputted sequentially from the laser scan optical system 13 are projected on the surface of the photosensitive drum 11 and an electrostatic latent image is formed.

<Developing Device>

As illustrated in FIG. 1, in the full color developing device 14, four different color developing units 14Y, 14M, 14C and 14K where Y (yellow), M (magenta), C (cyan) and K (black) toners are loaded respectively are mounted on a developing rack 14R. The developing rack 14R is mounted around a shaft 14P in a manner that it can rotate counterclockwise. In this full color developing device 14, each time an electrostatic latent image for a color is formed on the surface of the photosensitive drum 11, the corresponding developing unit is set to its developing position to develop the electrostatic latent image. The toner loaded may be a one-component developer or a two-component developer.

<Paper Feeding, Conveyance, Paper Delivery>

As illustrated in FIG. 1, the paper cassette 19 contains sheets of recording paper on which a toner image is transferred and a paper feed roller 19*a* feeds out paper sheets one by one. In the recording paper conveying route, there are timing rollers 20 which send recording paper to a secondary transfer position (the position of the secondary transfer roller 16) synchronously with the arrival of a toner image formed on the intermediate transfer belt 17 at the secondary transfer position. A fixing device 21 and a paper delivery tray 22 are provided downstream of the timing rollers 20 in the recording paper conveying direction.

<Transfer Device>

The transfer device consists of a primary transfer section and a secondary transfer section. The primary transfer section consists of a primary transfer brush 15 and an endless intermediate transfer belt 17 wound around plural support rollers. As shown in FIG. 1, as the photosensitive drum 11 rotates in the direction of arrow A, the intermediate transfer belt 17 moves in the direction of arrow B at the same peripheral velocity as that of the surface of the photosensitive drum 11. The primary transfer brush 15 is positioned opposite to the photosensitive drum 11 with the intermediate transfer belt 17 between the brush and the drum. When primary transfer voltage is applied to the primary transfer brush 15, the toner image formed on the photosensitive drum 11 is transferred to the intermediate transfer belt 17.

The secondary transfer section consists of a secondary transfer roller 16 which is positioned opposite to a support roller supporting the intermediate transfer belt 17 with the intermediate transfer belt 17 between them, along the recording paper conveying route. When secondary transfer voltage is applied to the secondary transfer roller 16, four color toner images formed on the intermediate transfer belt 17 are overlapped with each other and the resulting full color toner image is transferred to recording paper conveyed just in time when the full color toner image arrives at the secondary transfer position.

<Operation of the Image Forming Apparatus>

The operation of the above image forming apparatus is briefly outlined. When printing operation is started, the photosensitive drum 11 and the intermediate transfer belt 17 are driven at the same peripheral velocity and the surface of the photosensitive drum 11 is electrified to a prescribed voltage by the brush charger 12.

Latent images are formed on the surface of the electrified photosensitive drum 11 by laser beams projected from the laser scan optical system 13. First, a Y (yellow) latent image is formed, then the latent image is developed by the corresponding color developing unit 14Y and the developed toner image is transferred to the intermediate transfer belt 17. After that, M (magenta), C (cyan) and K (black) latent images are formed sequentially and these latent images are developed by the corresponding color developing units 14M, 14C and 14K respectively and sequentially; the developed tone images are laid over the toner image previously transferred on the intermediate transfer belt 17, resulting a full color toner image.

The full color toner image formed on the intermediate transfer belt 17 is transferred to recording paper by the secondary transfer roller 16. The recording paper sheet bearing the full color toner image is conveyed to the fixing device 21 and fixed before being delivered into the delivery tray. This concludes the process of making an image on a sheet of paper.

<Charger Mode Switching Device>

In the brush charger 12 of the above image forming apparatus, the charging brush 12*a* is made to rotate at a peripheral velocity higher than that of the photosensitive drum 11 to electrify the photosensitive drum 11. When it is not necessary to electrify the photosensitive drum 11, in order to minimize abrasion of the photosensitive drum 11, the drive for the charging brush 12*a* is turned off; consequently it is rotated passively as driven by rotation of the photosensitive drum 11. An explanation is given below of a drive device for switching a first mode in which the charging brush is actively rotated and a second mode in which the charging brush is rotated passively.

Figure 3A:
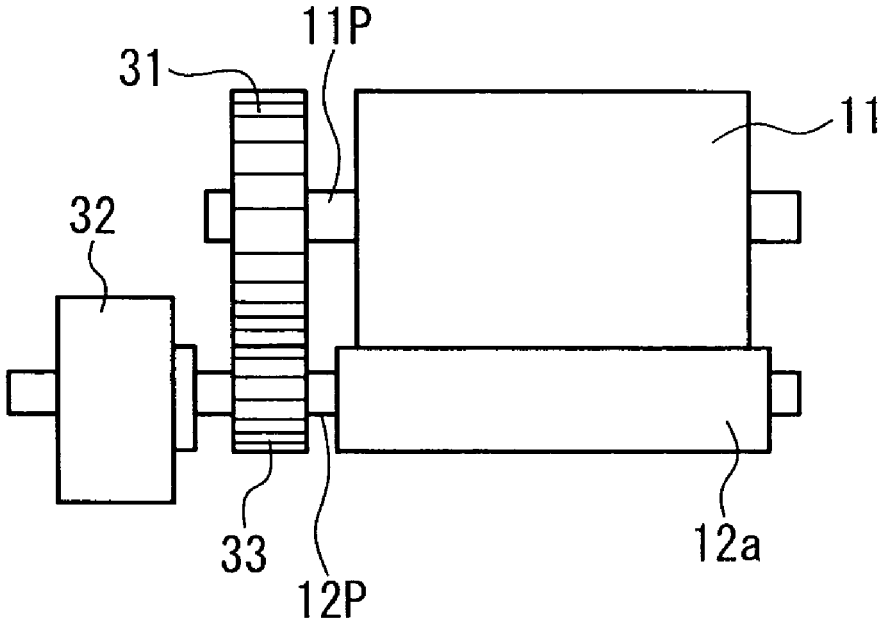
Figure 3B:
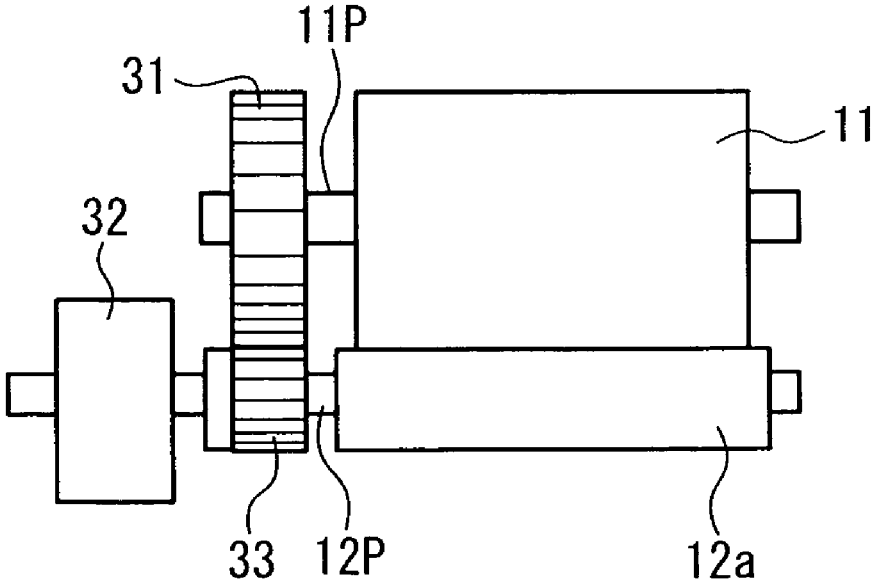

FIGS. 3(*a*) and 3(*b*) shows a drive device for the charging brush. FIG. 3(*a*) shows a condition that the electromagnetic clutch 32 is OFF and the drive for the charging brush 12*a* is turned off. FIG. 3(*b*) shows a condition that the electromagnetic clutch 32 is ON and the drive for the charging brush 12*a* is turned on. FIGS. 3(*a*) and 3(*b*) schematically show how an electromagnetic clutch with a known structure functions.

Referring to FIGS. 3(*a*) and 3(*b*), the shaft 11*p* of the photosensitive drum 11 is connected with a gear 31 connected with a drive source (not shown) and the photosensitive drum 11 is rotated through the gear 31 by the drive source (not shown). On the shaft 12*p* of the charging brush 12*a* to be in contact with the photosensitive drum 11, there is a gear 33 to engage with the gear 31. When the electromagnetic clutch 32 is OFF, the gear 33 is not connected with the shaft 12*p* and rotated idly over the shaft 12*p*. Therefore, the drive for the charging brush 12*a* is turned off and the charging brush 12*a* comes into contact with the photosensitive drum 11 and rotates passively as driven by the photosensitive drum 11. When the electromagnetic clutch 32 is ON, the gear 33 is connected with the shaft 12*p* and rotation of the gear 31 rotates the gear 33, thus rotating the charging brush 12*a* actively.

The electromagnetic clutch 32 is turned ON and OFF under the control of a control unit (stated later). The ratio of the peripheral velocity of the charging brush 12*a* to the peripheral velocity of the photosensitive drum 11 (peripheral velocity ratio) can be adjusted to a desired value more than 1 by adjusting the gear ratio of the gear 31 to the gear 33.

The drive source may be a drive source which drives the photosensitive drum 11 or an independent drive source such as a motor. The electromagnetic clutch 32 is located between the shaft 12*p* and the gear 33 but may be located between the shaft 11*p* and the gear 31 instead. It is needless to say that instead of the electromagnetic clutch, another known engagement and disengagement device with a similar function may be used.

When the photosensitive drum 11 need not be charged, abrasion of the photosensitive drum 11 can be minimized by turning off the drive for the charging brush 12*a*. However, if the charging brush 12*a* is continuously rotated passively as driven by rotation of the photosensitive drum 11 for many hours, the brush fibers of the charging brush 12*a* may become disordered, which could unfavorably affect charge of the photosensitive drum In this embodiment, the cumulative number of passive rotations of the charging brush 12*a* is counted, and when the count exceeds a prescribed value, the charging brush 12*a* is actively rotated (at the same time, the photosensitive drum 11 is rotated) regardless of image printing operation, in order to remedy the disordered brush fibers. This process is controlled by an electromagnetic clutch under the control of a control unit 40.

The abovementioned "prescribed value" which is compared with the cumulative number of passive rotations of the charging brush 12*a* is, for example, 20,000, preferably 15,000, more preferably 12,000, and most preferably 10,000. The charging brush 12*a* may be actively rotated until the cumulative number of passive rotations exceeds this prescribed value.

As explained in later, in order to determine the above "prescribed value" (the number of passive rotations), after the brush 12*a* continues rotating passively, the condition of disordered brush fibers is visually checked and the number of passive rotations which corresponds to the brush fiber disorder tolerance limit is chosen.

<Control Unit>

Figure 4:
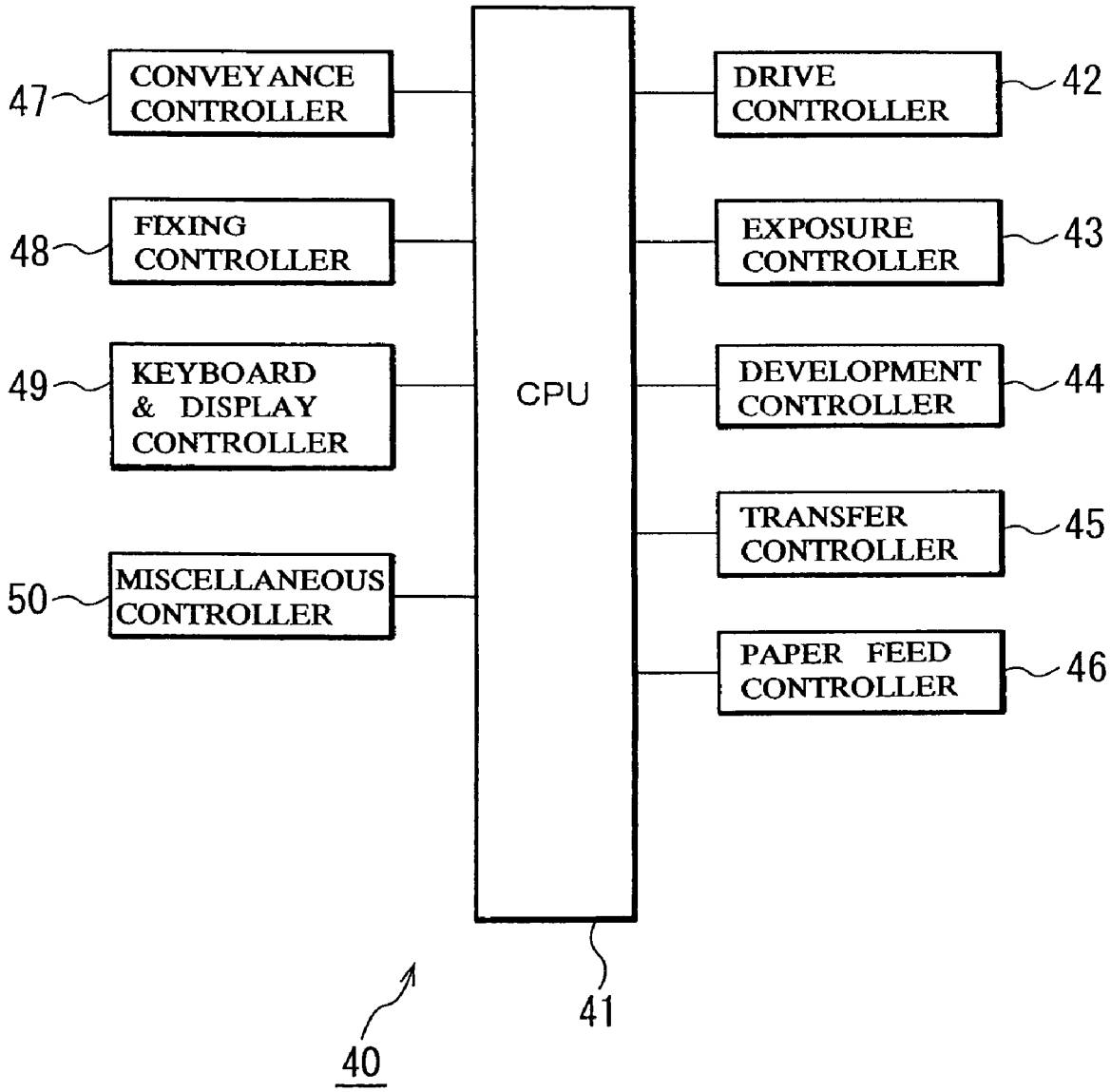
FIG. 4 is a block diagram showing a control unit for an image forming apparatus.

FIG. 4 shows a block diagram of the control unit 40 of the image forming apparatus. The control unit 40 is composed of a CPU 41 and various functional elements of the image forming apparatus which are connected with its input and output ports. Specifically, the input and output ports are connected with: a drive controller 42 for controlling various drive elements; an exposure controller 43 for controlling the laser scan optical system 13; a development controller 44 for controlling the full color developing device 14; a transfer controller 45 for controlling the primary transfer brush 15 and the secondary transfer roller 16 in the transfer part; a paper feed controller 46 for feeding recording paper from the paper cassette; a conveyance controller 47 for controlling conveyance of recording paper; a fixing controller 48 for controlling the fixing device; a keyboard & display controller 49 for controlling a keyboard and control panel display; and a miscellaneous controller 50.

Overall control of the image forming apparatus is not the subject of the present invention and its description is omitted here. Next is an explanation concerning how the drive controller 42 controls the charging brush 12*a* using the above electromagnetic clutch 32.

Figure 5:
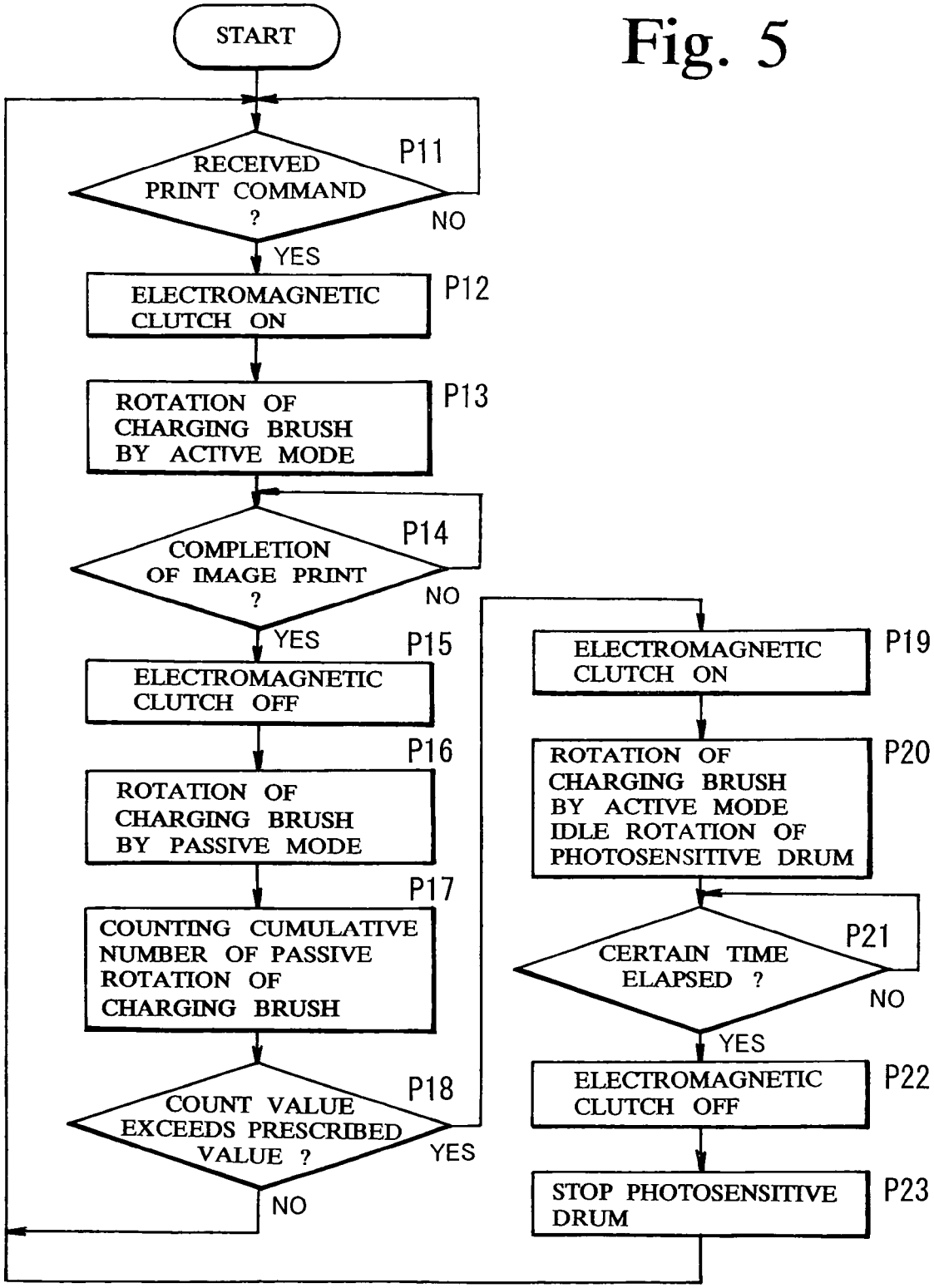
FIG. 5 is a flow chart illustrating control operation of the charging brush.

FIG. 5 is a flow chart showing the operation of drive controller 42 of the charging brush 12*a*. First, the system waits for entry of a print command (step P11); when a print command is received, the electromagnetic clutch 32 is turned ON and the charging brush 12*a* is switched to the active rotation mode to rotate the charging brush 12*a* actively (steps P12 and P13). At this time, the photosensitive drum 11 has already begun rotating. The system waits for completion of image printing (step P14). Upon completion of image printing, the electromagnetic clutch 32 is turned OFF and the charging brush 12*a* is switched to the passive rotation mode (steps P15 and P16).

The cumulative number of passive rotations of the charging brush 12*a* is counted (step P17); then a decision is made as to whether the count value exceeds a predetermined value or not (in this case, 20,000) (step P18). When the count value is not in excess of the predetermined value, the system returns to step P11 and waits for entry of a next print command. When the count value is in excess of the predetermined value, the electromagnetic clutch 32 is turned ON to rotate the charging brush 12*a* actively and at the same time let the photosensitive drum 11 rotate idly (steps P19 and P20).

The system waits for a certain time to elapse after turning ON the electromagnetic clutch (step P21). When the certain time has elapsed, the electromagnetic clutch is turned OFF and idling of the photosensitive drum 11 is stopped (steps P22 and P23); then the system returns to step P11 and waits for entry of a next print command.

Second Embodiment

The second embodiment concerns a rotary brush according to the present invention which is used in a cleaning device for removing toner adhering to a photosensitive belt, a transfer belt, or the like.

In this embodiment, general structure of image forming apparatus such as scan optical system, developing device, paper feed device, conveyance device, paper delivery device, transfer device and image forming operation are the same as in the first embodiment, therefore their descriptions are omitted here. An explanation given below focuses on a cleaning device.

Figure 6:
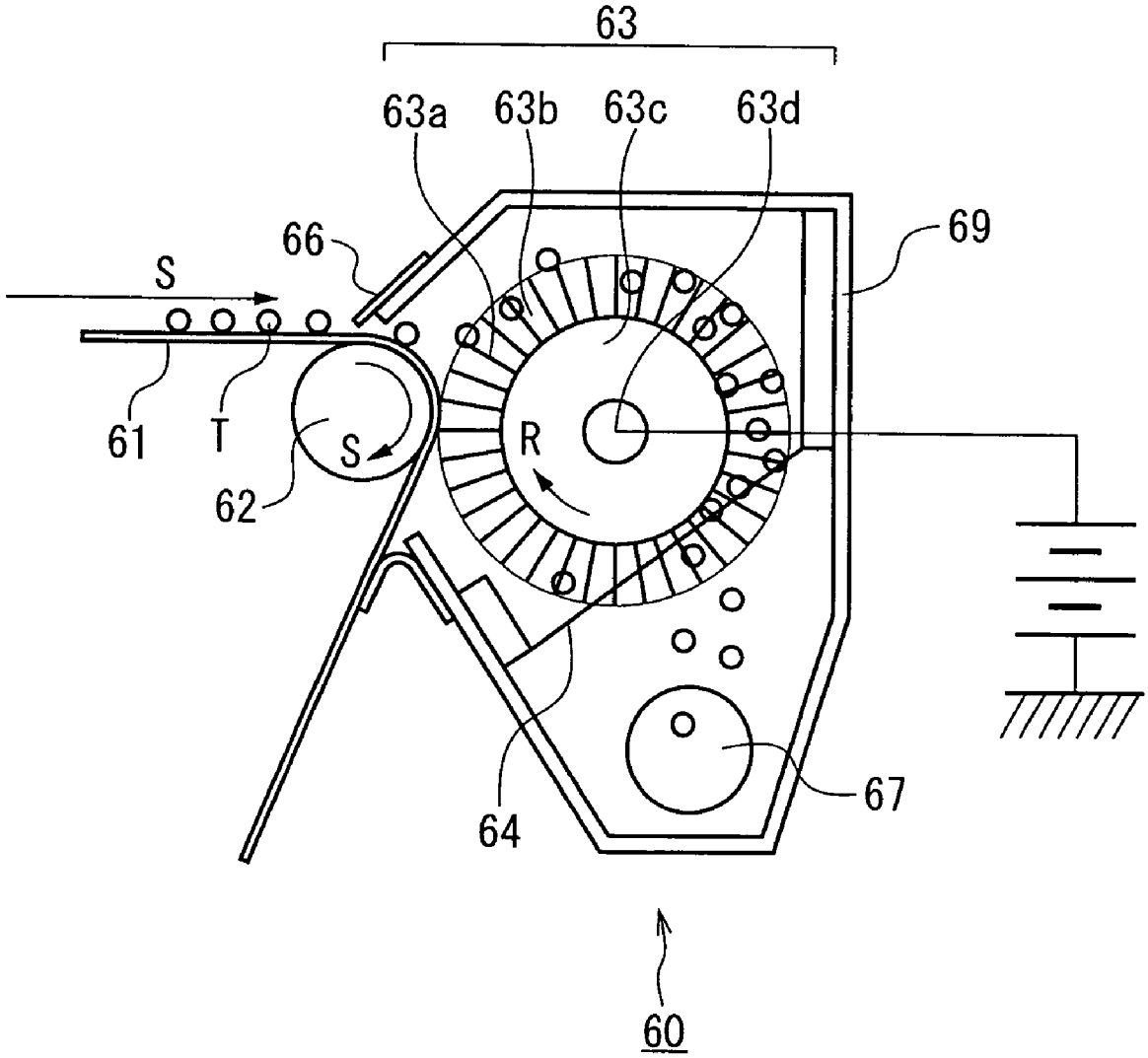
FIG. 6 illustrates the structure of a cleaning device according to a second embodiment of the present invention.

FIG. 6 illustrates the general structure of a cleaning device 60 as an example. A member to be cleaned 61, such as a photosensitive belt or transfer belt, is wound around a roller 62 which is facing the cleaning device 60. Although the member to be cleaned 61 as shown in FIG. 6 is a belt, it is not limited to a belt; instead, it may be a drum or roller (for example, a photosensitive drum or an charging roller).

The cleaning device 60 is composed of a brush 63 rotatably supported by a frame 69 and a mesh 64 for removing toner from the brush 63. The brush 63 is facing the roller 62. It consists of a base cloth 63*b* with brush fibers 63*a* planted thereon, which is wound around a metal core roller 63*c*. 63*d* is a rotary shaft which supports and rotates the brush 63.

In FIG. 6, numeral 67 represents a toner conveying duct which conveys waste toner from the fibers 63*a* of the brush 63 into a collection box not shown here located outside the cleaning device 60. Around the opening of the frame 69, there is a synthetic resin film 66 which prevents splashing of toner T removed by the brush 63 from the member to be cleaned 61.

The mesh 64 collects toner T from the brush 63 to refresh the brush 63. As the brush 63 rotates in contact with mesh 64, the brush fibers 63*a* bounce and remove adhering toner T. The refresh device may be in any form other than the above.

The brush 63 rotates in the direction opposite to the direction of movement of the member to be cleaned 61, namely in the direction of arrow R (clockwise) shown in FIG. 6. Although the member to be cleaned 61 which comes into contact with the brush 63 is so arranged as to move in the direction of arrow S which counters the brush 63, it may be so arranged as to move in the same direction as the brush 63.

It is desirable that the material, fiber planting density and fiber fineness and length for the brush fibers 63*a* of the brush 63 be within the ranges shown in Column A of FIG. 11 and more desirably in Column C.

The amount p of push for pressing the brush 63 against the member to be cleaned 61 should satisfy condition (1) given below and nip width n in the area of contact between the rotary brush and the rotary member should satisfy condition (2) given below.

$$0.1\ \text{mm} \leqq p \leqq 2.0\ \text{mm} \quad (1)$$

$$2.0\ \text{mm} \leqq n \leqq 10.0\ \text{mm} \quad (2)$$

Either condition (1) or condition (2) or both should be satisfied.

When the amount of push and the nip width are in the above ranges, the brush 63 will clean the member to be cleaned 61 satisfactorily and after active rotation of the brush 63 is stopped, the brush 63 will rotate passively as driven by the member to be cleaned 61. For example, during initialization just after turning on the image forming apparatus or during its warm-up just after the standby state, the member to be cleaned 61 may move or rotate idly. Also, if the member to be cleaned 61 and another device (for example, a recording paper conveying device) share a drive system, even after completion of image forming or image transfer, the member to be cleaned 61 may continue moving because the other device is to be driven. However, when the amount of push and the nip width for the brush are within the above ranges, abrasion of the member to be cleaned 61 which might occur during its idle movement or rotation can be prevented.

In order to remove toner T adhering to the member to be cleaned 61, voltage (100 V to 500 V) whose polarity is reverse to the toner used should be supplied to the brush 63 from a power supply 68. In addition, an charger may be provided to equalize the polarity of electrified toner adhering to the member to be cleaned 61, though not shown here.

In the above constitution, when toner T adhering to the member 61 to be cleaned which moves in the direction of arrow S passes through the nip area between the brush 63 and the member 61, the surface of the member 61 is cleaned, and toner T removed and transferred from member 61 to the brush 63 is further removed by the mesh 64 and conveyed through the toner conveying duct 67 into the collection box.

Third Embodiment

The third embodiment concerns a rotary brush according to the present invention which is used in a tandem image forming apparatus.

Figure 7:
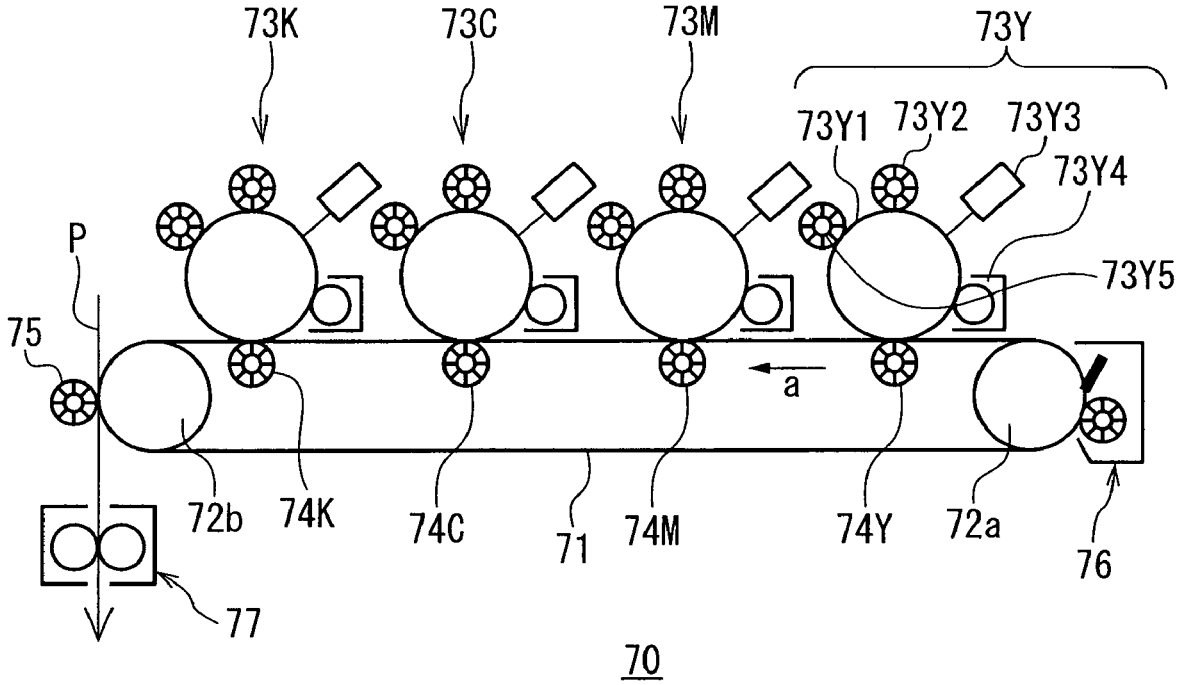
FIG. 7 illustrates the structure of a tandem image forming apparatus according to a third embodiment of the present invention.

FIG. 7 illustrates the structure of a tandem image forming apparatus 70. A transfer belt 71 is wound around a drive roller 72*a* and a winding roller 72*b*; as the drive roller 72*a* is rotated (driven) by a drive source (not shown), the transfer belt 71 moves in the direction of arrow a at a constant speed.

The following four imaging units are arranged in series along the upper surface of the transfer belt 71: an imaging unit 73Y for a yellow image, an imaging unit 73M for a magenta image, an image forming unit for a cyan image 73C, and an imaging unit 73K for a black image. Primary transfer devices 74Y, 74M, 74C, and 74K are respectively located opposite to the imaging units 73Y, 73M, 73C, and 73K with the transfer belt 71 between the transfer devices and the units.

Each of the imaging units 73Y, 73M, 73C, and 73K has a photosensitive drum, a charger, an exposure device, a developing device, and a cleaning device. For example, the imaging unit 73Y has a photosensitive drum 73Y1, a charger 73Y2, an exposure device 73Y3, a developing device 73Y4, and a cleaning device 73Y5. The imaging units 73Y, 73M, 73C, and 73K are respectively loaded with yellow toner, magenta toner, cyan toner and black toner. A secondary transfer roller 75 is located opposite to the winding roller 72*b* with the transfer belt 71 between them in a way that recording paper P is led from a paper feeder (not shown) into between the transfer belt 71 and the secondary transfer roller 75. A fixing device 77 is provided downstream in the direction of recording paper feed.

A cleaning device 76, which consists of a cleaning blade and a cleaning brush, is located opposite to the drive roller 72*a* with the transfer belt 71 between them in order to remove residual toner on the transfer belt 71.

The above structure of the tandem image forming apparatus is well known. Its operation is briefly outlined next. When a print command is issued, the photosensitive units of the imaging units 73Y, 73M, 73C, and 73K are electrified by their respective chargers. Yellow, magenta, cyan, and black image signals are sent to the imaging units 73Y, 73M, 73C, and 73K sequentially and electrostatic latent images corresponding to these image signals are formed on the photosensitive units of the imaging units. The latent images are developed by the respective developing devices and four color toner images produced are then transferred to the transfer belt 71 sequentially and overlapped with each other.

First, the yellow toner image made by the imaging unit 73Y is transferred to the transfer belt 71 by means of the primary transfer device 74Y. Then, the magenta toner image made by the imaging unit 73M is transferred to the transfer belt 71 by means of the primary transfer device 74M in a way to overlie the transferred yellow toner image. Similarly, the cyan toner image made by the imaging unit 73C is transferred by means of the primary transfer device 74C in a way to overlie the previous toner image, and the black toner image made by the imaging unit 73K is transferred by means of the primary transfer device 74K in a way to overlie the previous toner image. Thus a full color toner image is produced.

Recording paper P is conveyed from the paper feeder (not shown) to the secondary transfer position just in time when the full color toner image transferred on the transfer belt 71 arrives at the position of the secondary transfer roller 75 as the transfer belt 71 moves. The full color toner image on the transfer belt 71 is transferred to the recording paper by means of the secondary transfer roller 75 at the secondary transfer position. The transferred toner image on the recording paper passes through the fixing device 77 where it is fixed; then the paper sheet is unloaded.

On the other hand, the transfer belt 71 is cleaned by removing the residual toner on it by the cleaning device 76 facing the drive roller 72*a*.

In this tandem image forming apparatus, the time of idle rotation of the photosensitive drum of each imaging unit is longer. Specifically, in the abovementioned process, after transfer of the yellow toner image made by the imaging unit 73Y to the transfer belt 71, the photosensitive drum of the imaging unit 73Y idly rotates while images are being made by the imaging units 73M, 73C, and 73K. During this idle rotation, the photosensitive drum abrades away due to the charger or cleaning device.

In addition, when the tandem imaging apparatus is to make a monochrome image (for instance, black and white), only the imaging unit 73K is activated while the other imaging units 73Y, 73M and 73C make no images and their photosensitive drums idly rotate. Also when making a single-color image, the imaging units which make no images rotate idly.

Therefore, according to the present invention, the charging brush and cleaning brush are used in the above tandem image forming apparatus for the purpose of reducing abrasion of the photosensitive drum and transfer belt. Specifically, the brush charger described in connection with the first embodiment is used as the charger 73Y2 of the imaging unit 73Y. The same brush is so used for the other imaging units 73M, 73C, and 73K. Also, the cleaning device described in connection with the second embodiment is used as the cleaning device 73Y5 of the imaging unit 73Y. The same cleaning device is also used for the other imaging units 73M, 73C, and 73K. The brush cleaning device described in connection with the second embodiment is used as the cleaning device 76 for the transfer belt 71.

Figure 8:
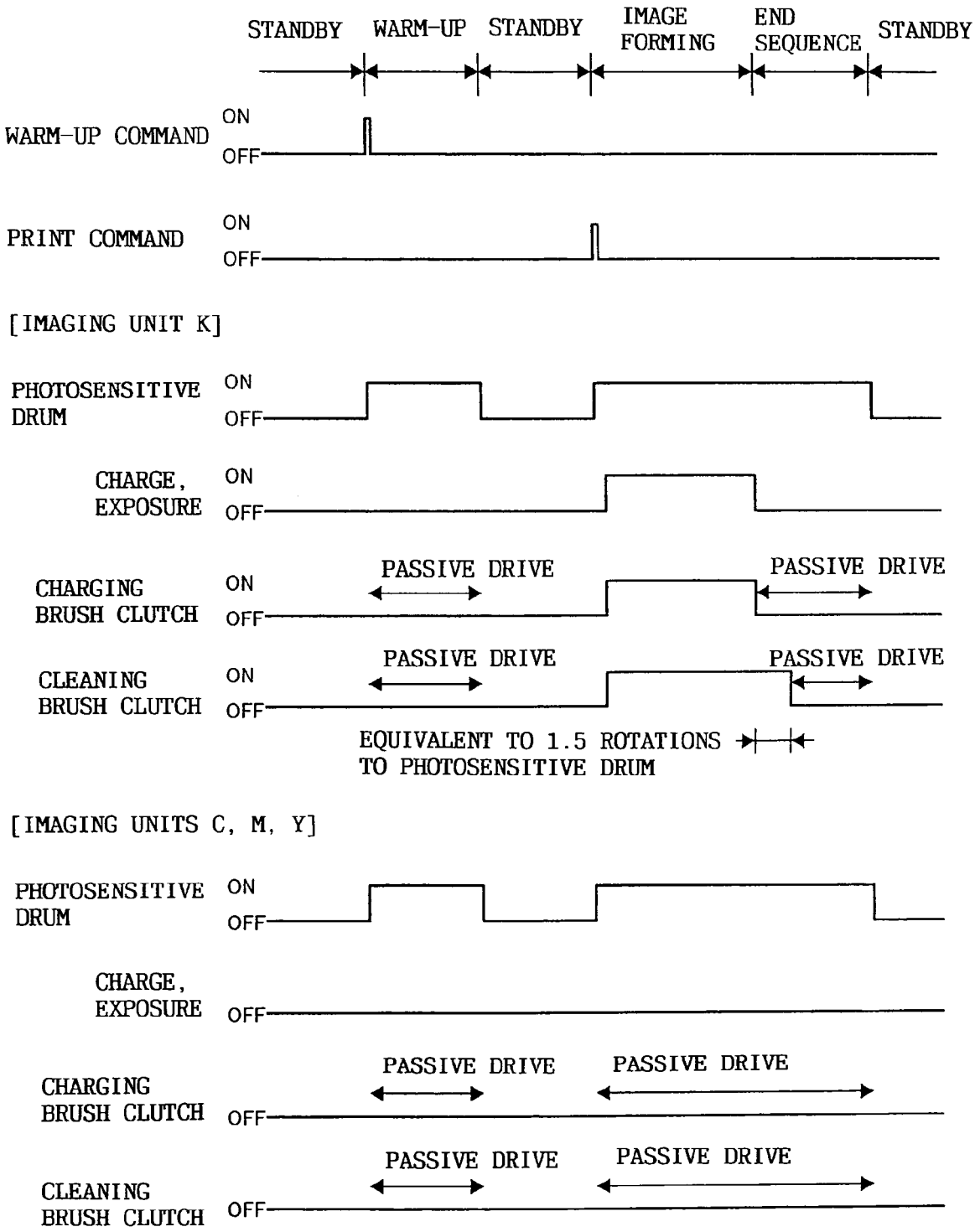
FIG. 8 is a timing chart illustrating the sequence of switching the passive and active rotation modes for a brush charger and a cleaning device according to the third embodiment of the present invention.

For the brush of the brush charger or brush cleaning device, there are two operation modes: a first mode (active rotation) in which the brush is actively rotated by a drive unit and a second mode (passive rotation) in which it is passively rotated in contact with the photosensitive drum. The electromagnetic clutch switches from the first mode (active rotation) to the second mode (passive rotation) and vice versa, as explained in connection with the first embodiment. Referring to the timing chart shown in FIG. 8, an explanation is given below concerning how active rotation and passive rotation of the brush charger or the brush cleaning device are switched in the process of making a monochrome (black and white) image on the tandem image forming apparatus.

The image forming apparatus operates in the following order: standby, warm-up, standby, image forming, end sequence, and standby. When a warm-up command is entered, the photosensitive drum of the imaging unit [K] (73K (black) and the photosensitive drums of the imaging units [C,M,Y] (73*c*(cyan), 73M (magenta), and 73Y (yellow)) are driven for a prescribed warm-up period and then brought into a standby state. During the warm-up period, the electromagnetic clutches for the charging brushes and cleaning brushes of the imaging unit 73K and imaging units 73C, 73M, and 73Y are turned OFF and the charging brushes and cleaning brushes are rotated passively as driven by rotation of the photosensitive drums.

When a print command is entered, the photosensitive drum of the imaging unit 73K is driven to make an image and the end sequence including image transfer and fixing is carried out. During the imaging period, the charger and the exposure device are activated. In other words, the electromagnetic clutch for the charging brush is turned ON to make the charging brush rotates actively. Also the electromagnetic clutch for the cleaning brush is turned ON to make the cleaning brush rotate actively, though the cleaning brush actively rotates longer by the time equivalent to 1.5 rotations of the photosensitive drum. After the image forming period is over, the photosensitive drum continues rotating actively until the end sequence is over but the charging brush and the cleaning brush rotate passively as driven by rotation of the photosensitive drum.

When a print command is entered, the photosensitive drums of the imaging units 73C, 73M, and 73Y are also rotated actively during the imaging period and the end sequence. However, in these periods, the electromagnetic clutches for the charging brushes and cleaning brushes of the imaging units 73C, 73M, and 73Y are turned OFF and the charging brushes and cleaning brushes are rotated passively as driven by rotation of the photosensitive drums.

As explained above, the charging brush and cleaning brush of the imaging unit which makes an image are actively rotated only while an image is being made on the photosensitive drum, and are rotated passively as driven by rotation of the photosensitive drum during the other periods. The charging brushes and cleaning brushes of the imaging units which do not make images are rotated passively as driven by rotation of their photosensitive drums throughout the process so that abrasion of the photosensitive drums is minimized.

Fourth Embodiment

Figure 9:
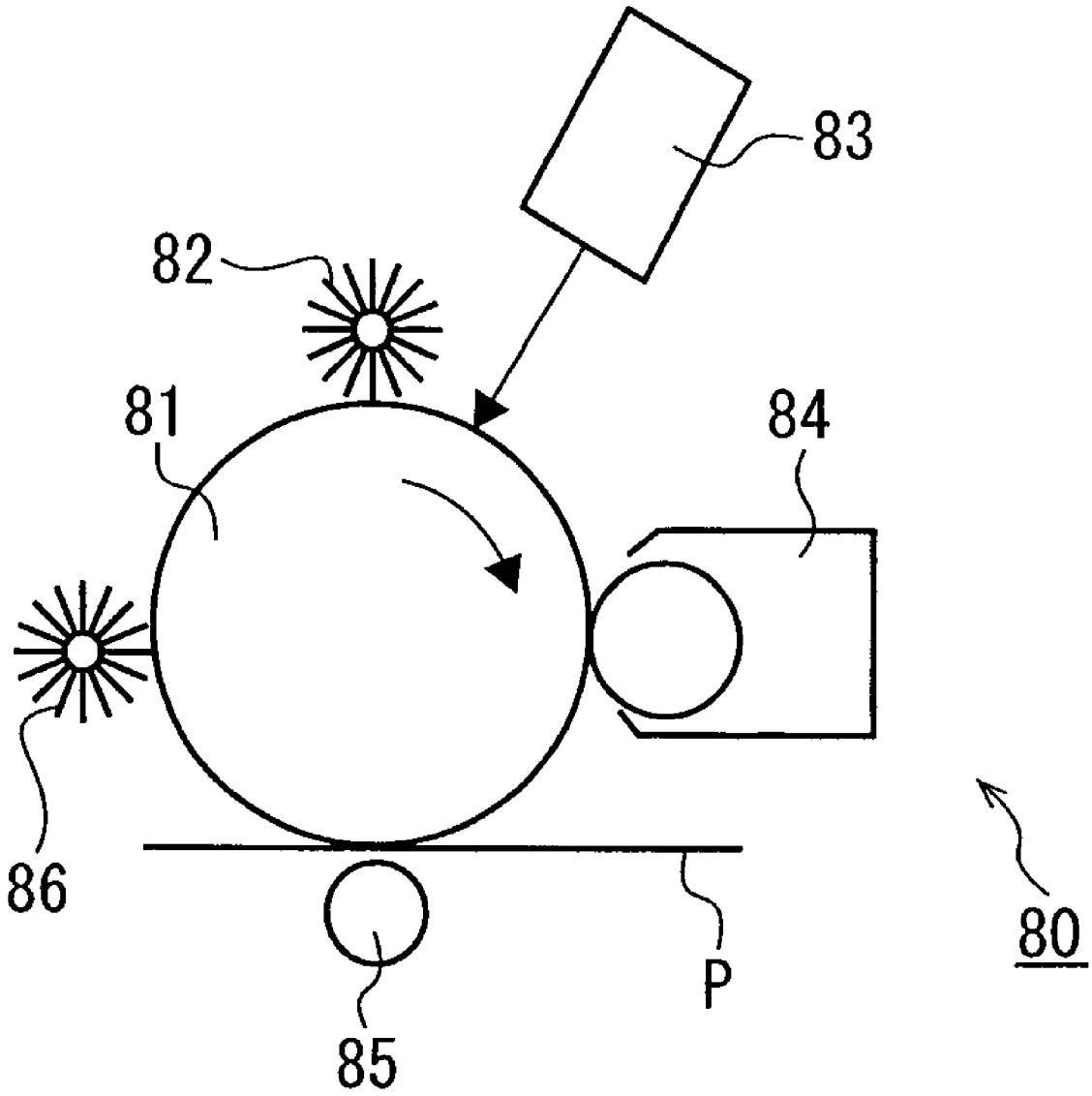
FIG. 9 illustrates the structure of a monochrome image forming apparatus according to a fourth embodiment of the present invention.

The fourth embodiment concerns a rotary brush according to the present invention which is used in a monochrome (black and white) image forming apparatus. FIG. 9 illustrates the structure of a monochrome image forming apparatus 80. A charger 82, an exposure device 83, a developing device 84, a transfer device 85, and a cleaning device 86 are provided around a photosensitive drum 81.

The above structure of the monochrome image forming apparatus is well known. Its operation is briefly outlined next. When an image print command is issued, the photosensitive drum 81 is charged by the charger 82. An image signal is sent to the exposure device 83 and an electrostatic latent image is formed on the photosensitive drum 81. Then, the latent image is developed by the developing device 84 to turn out a toner image. Recording paper P is conveyed from a paper feeder (not shown) to the transfer position just in time when the toner image arrives at the transfer position as the photosensitive drum 81 rotates. The toner image is transferred to recording paper P by means of the transfer device 85. The transferred toner image on the recording paper passes through a fixing device (not shown) where it is fixed, and the recording sheet is unloaded. On the other hand, the photosensitive drum is cleaned by removing the residual toner on the photosensitive drum 81 by the cleaning device 86.

In this monochrome image forming apparatus, if a common drive system is used to drive both the photosensitive drum and another device such as a recording paper conveying device, before formation of an image on the photosensitive unit or even after completion of image transfer, the photosensitive drum still continues rotating actively because the other device is to be driven. During initialization just after turning on the image forming apparatus or during its warm-up just after the standby state, the photosensitive drum rotates idly. However, when the rotary brush according to the present invention is used, abrasion of the photosensitive drum that might occur during its idle rotation can be prevented.

In the above first through fourth embodiments, the rotary member to be in contact with the rotary brush according to the present invention is a photosensitive drum. Alternatively, the rotary member to be in contact with the rotary brush may be a charging roller. In this case, the rotary brush will function as a brush that charges or cleans charging roller. The rotary brush according to the present invention may also be used as a transfer device.

Experiments on the Rotary Brush

Experiments on the rotary brush according to the present invention and evaluations of the experiment results are explained next. The experiments and evaluations are intended to check the degree of abrasion of the rotary member that is in contact with the rotary brush and evaluate change in the rotary brush condition and its influence on the image formed.

(A) Experiment I

In Experiment I, the rotary brush was an charging brush and the rotary member to be in contact with the rotary brush was a photosensitive drum. In Experiment I, samples 11 to 16 and references 11 and 12 for comparison were used as listed in FIG. 12. FIG. 12 shows test samples, references and evaluations of the test results.

<Charging Brush>

The brush material was a polyamide resin with conductive carbon dispersed therein. A fiber-planted base cloth is spirally wound around a stainless steel support core with a diameter of 6 mm, where the fiber was 2 deniers in fineness and the fiber planting density was 300,000 filaments/25.4 $mm^2$ (1 inch square). The fibers were cut so that the outside diameter of the brush was uniformly 15 mm. Furthermore, the tips of the fibers were curled by heat treatment so that the outside diameter of the brush with curled fiber tips was 12.5 mm.

<Test Method>

Figure 10A:
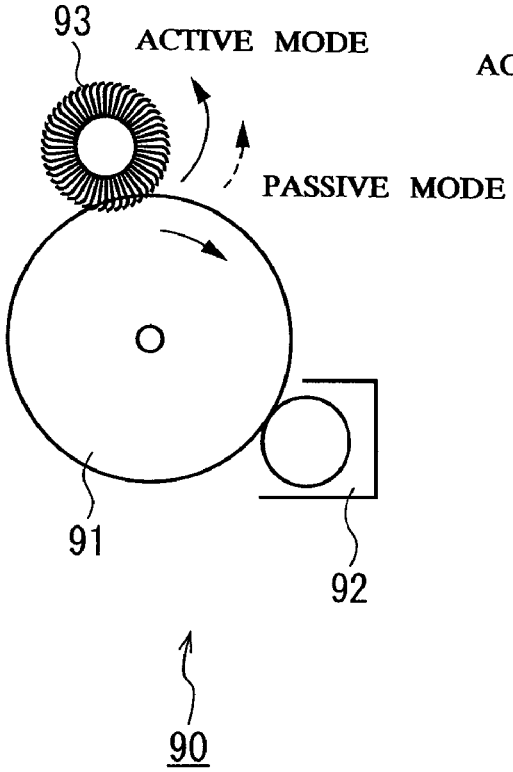
FIGS. 10(*a*) and 10(*b*) illustrates testing equipment for an charging brush and a cleaning brush.
Figure 10B:
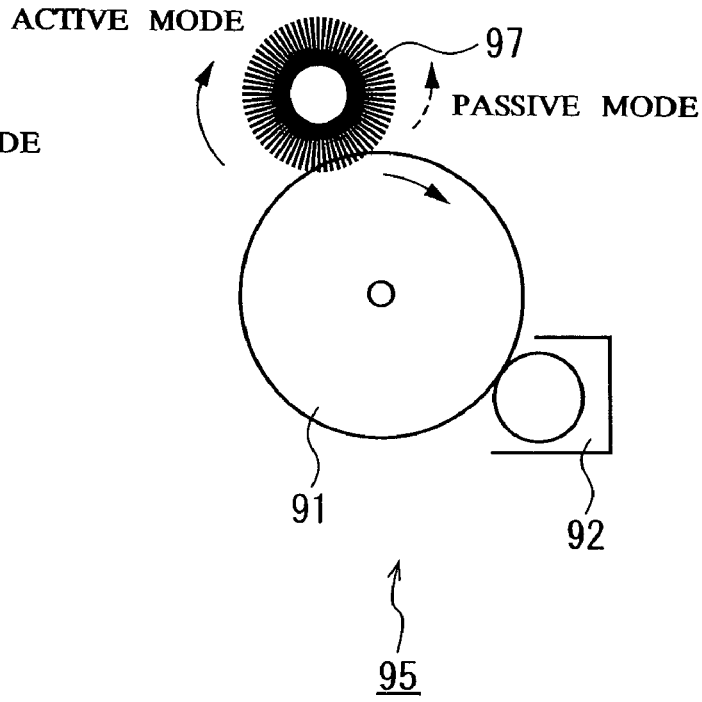

The testing equipment 90 employed is shown in FIGS. 10(*a*) and 10(*b*). In this testing equipment 90, a developing device 92 loaded with a one-component developer was provided close to a photosensitive unit (drum) 91 which was in contact with developer to accelerate abrasion. With the photosensitive drum 91 in contact with the charging brush 93, the same device as the operation mode switching device shown in FIGS. 3(*a*) and 3(*b*) was used to turn ON and OFF an electromagnetic clutch to switch between the active and passive modes of the charging brush 93. The one-component developer was commercial black toner for laser printer "Magicolor 2200" manufactured by Minolta QMS Company.

<Test Conditions>

Endurance tests in which the photosensitive drum was driven for 20 hours (approx. 120,000 rotations in total) were conducted at 25° C. and a relative humidity of 50% under the following test conditions. As shown in FIG. 12, samples conditions are different in various aspects: charging brush passive/active rotation mode switching; amount of push p and nip width n for the charging brush; voltage application in passive rotation; photosensitive drum drive time before forced rotation of the charging brush (cumulative number of rotations of the charging brush).

Photosensitive drum diameter: 30 mm.

System speed: 160 mm/sec.

Direction of charging brush active rotation: "with" direction, peripheral velocity ratio 2.

Drive time for charging brush active rotation: 30 seconds.

Applied voltage in charging brush active rotation: −1100 VDC.

Applied voltage in charging brush passive rotation: −1100 VDC.

Amount of push p and nip width n for the charging brush: as shown in FIG. 12.

Photosensitive drum drive time before forced rotation of the charging brush: as shown in FIG. 12.

The time to switch between the active and passive modes for the charging brush was determined based on photosensitive drum drive time into which the cumulative numbers of rotations of the photosensitive drum and charging brush were converted according to the system speed. In this case, one second of drive time corresponds to 1.7 rotations of the photosensitive drum.

When the amount of push p for the charging brush is 0.5 mm, one second of drive time corresponds to 8.9 rotations in the active rotation mode and 4.4 rotations in the passive rotation mode. When the amount of push p for the charging brush is 0.05 mm, one second of drive time corresponds to 8.2 rotations in the active rotation mode and 4.1 rotations in the passive rotation mode.

<Image Sample for Evaluation>

With a test photosensitive drum and a test charging brush mounted on the monochrome image forming apparatus shown in FIG. 9, an image sample for evaluation was printed after the endurance tests. The following printing conditions were used.

System speed: 160 mm/second.

Amount of push p and nip width n for the charging brush: 0.5 mm (nip width 4.9 mm).

Direction of charging brush active rotation: "with" direction, peripheral velocity ratio 2.

Applied voltage in charging brush active rotation: −1100 VDC.

Output image: 2 dots by 2 dots, monochrome halftone image.

(B) Experiment II

In Experiment II, the rotary brush was a cleaning brush and the rotary member to be in contact with the rotary brush was a photosensitive drum. In Experiment II, samples 21 to 29 and references 21 to 23 for comparison were used as listed in FIG. 13. FIG. 13 shows test samples, references and evaluations of the test results.

<Cleaning Brush>

The brush material was a polyamide resin with conductive carbon dispersed therein. A fiber-planted base cloth is spirally wound around a stainless steel support core with a diameter of 6 mm, where the fiber was 2 deniers in fineness and the fiber planting density was 300,000 filaments/25.4 $mm^2$ (1 inch square). The fibers were cut so that the outside diameter of the brush was uniformly 16 mm. In this case, the fibers were not curled.

<Test Method>

The testing equipment 95 employed is shown in FIG. 10(*b*). In this testing equipment 95, a developing device 92 loaded with a one-component developer was provided close to a photosensitive unit (drum) 91, which was in contact with developer to accelerate abrasion. With the photosensitive drum 91 in contact with the abovementioned cleaning brush 97, the same device as the operation mode switching device shown in FIGS. 3(*a*) and 3(*b*) was used to turn ON and OFF an electromagnetic clutch to switch between the active and passive modes of the cleaning brush 97.

<Test Conditions>

Endurance tests in which the photosensitive drum was driven for 20 hours (approx. 120,000 rotations in total) were conducted at 25° C. and a relative humidity of 50% under the following test conditions. As shown in FIG. 13, samples are different in various aspects: cleaning brush passive/active rotation mode switching; amount of push p and nip width n for the cleaning brush; voltage application in passive rotation; and photosensitive drum drive time before forced rotation of the cleaning brush (cumulative number of rotations of the cleaning brush).

Photosensitive drum diameter: 30 mm.

System speed: 160 mm/sec.

Printing speed: 20 sheets/minute.

Direction of cleaning brush active rotation: "counter" direction, peripheral velocity ratio 2.

Drive time for cleaning brush active rotation: 30 seconds.

Applied voltage in cleaning brush active rotation: 500 VDC.

Applied voltage in cleaning brush passive rotation: 500 VDC.

Amount of push p and nip width n for the cleaning brush: as shown in FIG. 13.

Photosensitive drum drive time before forced rotation of the cleaning brush: as shown in FIG. 13.

The time to switch between the active and passive modes for the cleaning brush was determined based on photosensitive drum drive time into which the cumulative numbers of rotations of the photosensitive drum and cleaning brush were converted according to the system speed. In this case, one second of drive time corresponds to 1.7 rotations of the photosensitive drum.

When the amount of push p for the cleaning brush is 0.5 mm, one second of drive time corresponds to 6.8 rotations in the active rotation mode and 3.4 rotations in the passive rotation mode. When the amount of push p for the cleaning brush is 2.5 mm, one second of drive time corresponds to 9.3 rotations in the active rotation mode and 4.6 rotations in the passive rotation mode.

<Image Sample for Evaluation>

With a test photosensitive drum and a test cleaning brush mounted on the monochrome image forming apparatus as shown in FIG. 9, an image sample for evaluation was printed after the endurance tests. The following printing conditions were used.

System speed: 160 mm/second.

Direction of cleaning brush active rotation: "counter" direction, peripheral velocity ratio 2.

Applied voltage in cleaning brush active rotation: 500 VDC.

Probe voltage: −2000 VDC.

Grid voltage: −500 VDC.

Amount of push p and nip width n for the cleaning brush: 0.5 mm (nip width 5.6 mm).

Output image: 2 dots by 2 dots, monochrome halftone image.

(C) Evaluation of Test Results

The rotary brush was evaluated in three aspects. Firstly, the degree of abrasion of the opposite rotary member (the surface photosensitive layer thickness (μm) of the photosensitive drum in the actual test) was measured. The second aspect was the condition of the rotary brush and the third aspect was output image quality. The condition of the rotary brush (the second aspect) was checked by visual inspection and output image quality (the third aspect) was visually compared with the reference image for evaluation.

The overall evaluations were made according to the following classification:

Excellent (marked with a double circle): The rotary brush has no disordered fibers and the image has no unevenness.

Good (marked with a single circle): The rotary brush has some disordered fibers but the image has no unevenness, or the rotary brush has no disordered fibers but the image has slight unevenness.

Acceptable (marked with a single triangle): The rotary brush has some disordered fibers and the image has slight unevenness, or the brush has apparent disordered fibers but the image has no unevenness.

Not good (marked with two triangles): The image has apparent unevenness (streaks).

Unacceptable (marked with a cross): The image has serious unevenness (streaks).

The test results which were classified into the excellent (double circle), good (circle), and acceptable (single triangle) groups were considered as having passed the test.

The evaluations of the test results are as shown in FIG. 12 and FIG. 13. When the rotary member (photosensitive drum in the tests) opposite to the rotary brush was continuously rotated, abrasion of the surface of the rotary member and output image degradation were smaller with the rotary brush in the second mode (passive rotation) than in the first mode (active rotation). When the amount of push p was out of the range of 0.1 mm≦p or the nip width n was out of the range of 2 mm≦n, the rotary brush was less easy to rotate passively and its velocity difference from the opposite rotary member was larger; as a consequence, many streaks appeared in the output image probably because of surface abrasion of the opposite rotary member.

When the amount of push p was out of the range of p≦2 mm (beyond the permissible range) or the nip width n was out of the range of n≦10 mm (beyond the permissible range), a remarkable deformation of the rotary brush in the nip area and its vicinity and disordered brush fibers were observed, and a lot of streaks and image unevenness, which were probably attributable to uneven contact with the opposite rotary member surface, were found in output image evaluation.

It was also observed that when the rotary brush was rotated actively in the first mode for a certain duration each time it had made a given number of passive rotations in the second mode, brush fiber disorder and image unevenness were alleviated. Also, application of voltage to the rotary brush during its passive rotation contributed to reduction in brush fiber disorder and image unevenness.

The evaluations of the test results of sample conditions 11 through 16 in FIGS. 12 and 21 through 29 in FIG. 13 demonstrate that brush fiber disorder in the rotary brush is reduced when the rotary brush is made to rotate actively in the first mode before the cumulative number of its passive rotations in the second mode exceeds 20,000, more preferably 15,000.

As detailed so far, the present invention relates to an electrophotographic image forming apparatus and more particularly to a rotary brush that is used for an charger for electrically charging an photosensitive image carrier, a cleaning device for removing residual toner from the surface of an photosensitive image carrier, or another similar device. According to the invention, abrasion of a rotary member such as an photosensitive image carrier can be reduced by properly setting the amount of push for pressing the rotary brush against the rotary member and/or the nip width in the are of contact between the rotary brush and the rotary member. In addition, it is possible to prevent an excessive force which deforms the rotary brush in the area of contact with the rotary member or in its vicinity, so that rotary brush fiber disorder is less likely to occur.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming apparatus, comprising:

a rotary member capable of carrying an image recording material on its surface;

a rotary brush which rubs and slides on the surface of the rotary member;

a counter for counting a number of rotations of the rotary brush, and a controller which controls operation of the rotary brush;

wherein, the controller operates in two control modes, a first mode for active rotation of the rotary brush, and a second mode for passive rotation of the rotary brush as driven by rotation of the rotary member, and wherein the controller executes the first mode before a cumulative number of rotations of the rotary brush in the second mode, as counted by the counter, exceeds a prescribed number of rotations.

2. An image forming apparatus, comprising:

a plurality of components, each of which comprise;

a developing device, a photosensitive image carrier on which an image is formed by the developing device and a rotary brush which rubs and slides on the surface of the photosensitive image carrier, a controller which controls operation of each rotary brush; and a counter for counting a number of rotations of the rotary brush;

wherein, the controller operates in two control modes, a first mode for active rotation of the rotary brush and a second mode for passive rotation of the rotary brush as driven by rotation of the photosensitive image carrier and wherein the controller executes the first mode before the cumulative number of rotations of the rotary brushes of the plural components in the second mode exceeds a prescribed number of rotations.

3. The image forming apparatus as claimed in claim 2, wherein the amount of push p for pressing the rotary brush against the rotary member satisfies the following condition, $$0.1\ \text{mm} \leqq p \leqq 2.0\ \text{mm}.$$

4. The image forming apparatus as claimed in claim 2, wherein nip width n in the area of contact between the rotary brush and the rotary member satisfies the following condition, $$2.0\ \text{mm} \leqq n \leqq 10.0\ \text{mm}.$$

5. The image forming apparatus as claimed in claim 2, wherein when only one component among the plural components makes an image and the other components do not make images, the controller controls the apparatus so as to execute the second mode for the rotary brushes of the other components.

6. The image forming apparatus as claimed in claim 2, wherein the rotary brush is an charging brush for electrically charging an photosensitive image carrier.

7. The image forming apparatus as claimed in claim 2, wherein the rotary brush is a cleaning brush for cleaning an photosensitive image carrier.

* * * * *